US007520325B2

(12) United States Patent
Hocking

(10) Patent No.: US 7,520,325 B2
(45) Date of Patent: Apr. 21, 2009

(54) ENHANCED HYDROCARBON RECOVERY BY IN SITU COMBUSTION OF OIL SAND FORMATIONS

(75) Inventor: Grant Hocking, Alpharetta, GA (US)

(73) Assignee: GeoSierra LLC, Alpharetta, GA (US)

( * ) Notice: Subject to any disclaimer, the term of this patent is extended or adjusted under 35 U.S.C. 154(b) by 43 days.

(21) Appl. No.: 11/626,175

(22) Filed: Jan. 23, 2007

(65) Prior Publication Data

US 2007/0199702 A1 Aug. 30, 2007

Related U.S. Application Data

(63) Continuation-in-part of application No. 11/363,540, filed on Feb. 27, 2006, and a continuation-in-part of application No. 11/277,308, filed on Mar. 23, 2006, now abandoned, and a continuation-in-part of application No. 11/277,775, filed on Mar. 29, 2006, now abandoned, and a continuation-in-part of application No. 11/277,815, filed on Mar. 29, 2006, now abandoned, and a continuation-in-part of application No. 11/277,789, filed on Mar. 29, 2006, now abandoned, and a continuation-in-part of application No. 11/278,470, filed on Apr. 3, 2006, now abandoned, and a continuation-in-part of application No. 11/379,123, filed on Apr. 18, 2006, now abandoned.

(51) Int. Cl.
*E21B 43/26* (2006.01)

(52) U.S. Cl. ..... 166/259; 166/260; 166/261; 166/57; 166/280.2

(58) Field of Classification Search ..... None
See application file for complete search history.

(56) References Cited

U.S. PATENT DOCUMENTS

| | | | |
|---|---|---|---|
| 1,789,993 | A | 1/1931 | Switzer |
| 2,178,554 | A | 11/1939 | Bowie |
| 2,548,360 | A | 4/1951 | Germain |
| 2,634,961 | A | 4/1953 | Ljungström |
| 2,732,195 | A | 1/1956 | Ljungström |
| 2,780,450 | A | 2/1957 | Ljungström |
| 3,059,909 | A | 10/1962 | Wise |
| 3,225,828 | A | 12/1965 | Wisenbaker |
| 3,301,723 | A | 1/1967 | Chrisp |

(Continued)

*Primary Examiner*—Zakiya W Bates
*Assistant Examiner*—Angela M DiTrani
(74) *Attorney, Agent, or Firm*—Smith, Gambrell & Russell

(57) ABSTRACT

The present invention is a method and apparatus for the enhanced recovery of petroleum fluids from the subsurface by in situ combustion of the hydrocarbon deposit, from injection of an oxygen rich gas and drawing off a flue gas to control the rate and propagation of the combustion front to be predominantly horizontal and propagating vertically downwards guided by the vertical highly permeable hydraulic fractures. Multiple propped vertical hydraulic fractures are constructed from the well bore into the oil sand formation and filled with a highly permeable proppant containing hydrodesulfurization and thermal cracking catalysts. The oxygen rich gas is injected via the well bore into the top of the propped fractures, the in situ hydrocarbons are ignited by a downhole burner, and the generated flue gas extracted from the bottom of the propped fractures through the well bore and mobile oil gravity drains through the propped fractures to the bottom of the well bore and pumped to the surface. The combustion front is predominantly horizontal, providing good vertical and lateral sweep, due to the flue gas exhaust control provided by the highly permeable propped fractures.

22 Claims, 5 Drawing Sheets

U.S. PATENT DOCUMENTS 3,349,847 A * 10/1967 Smith et al. ..... 166/259
3,739,852 A 6/1973 Woods et al.
3,888,312 A 6/1975 Tiner et al.
3,994,340 A 11/1976 Anderson et al.
4,085,803 A 4/1978 Butler
4,099,570 A 7/1978 Vandergrift
4,116,275 A 9/1978 Butler et al.
4,119,151 A 10/1978 Smith
4,271,696 A 6/1981 Wood
4,280,559 A 7/1981 Best
4,344,485 A 8/1982 Butler
4,450,913 A 5/1984 Allen et al.
4,454,916 A 6/1984 Shu
4,474,237 A 10/1984 Shu
4,513,819 A 4/1985 Islip et al.
4,519,454 A 5/1985 McMillen
4,566,536 A 1/1986 Holmes
4,597,441 A 7/1986 Ware et al.
4,598,770 A 7/1986 Shu et al.
4,625,800 A 12/1986 Venkatesan
4,696,345 A 9/1987 Hsueh
4,697,642 A 10/1987 Vogel
4,706,751 A 11/1987 Gondouin
4,716,960 A 1/1988 Eastlund et al.
4,926,941 A 5/1990 Glandt et al.
4,993,490 A 2/1991 Stephens et al.
5,002,431 A 3/1991 Heymans
5,046,559 A 9/1991 Glandt
5,054,551 A 10/1991 Duerksen
5,060,287 A 10/1991 Van Egmond
5,060,726 A 10/1991 Glandt et al.
5,065,818 A 11/1991 Van Egmond
5,103,911 A 4/1992 Heijnen
5,145,003 A 9/1992 Duerksen
5,211,230 A 5/1993 Ostapovich et al.
5,215,146 A 6/1993 Sanchez
5,255,742 A 10/1993 Mikus
5,273,111 A 12/1993 Brannan et al.
5,297,626 A 3/1994 Vinegar et al.
5,335,724 A 8/1994 Venditto
5,339,897 A 8/1994 Leaute
5,372,195 A 12/1994 Swanson
5,392,854 A 2/1995 Vinegar et al.
5,404,952 A 4/1995 Vinegar et al.
5,407,009 A 4/1995 Butler et al.
5,431,224 A 7/1995 Laall
5,472,049 A 12/1995 Chaffee
5,607,016 A 3/1997 Butler
5,626,191 A 5/1997 Greaves et al.
5,824,214 A 10/1998 Paul et al.
5,862,858 A 1/1999 Wellington et al.
5,871,637 A 2/1999 Brons
5,899,269 A 5/1999 Wellington et al.
5,899,274 A 5/1999 Frauenfeld et al.
5,954,946 A 9/1999 Klazinga et al.
6,023,554 A 2/2000 Vinegar et al.
6,056,057 A 5/2000 Vinegar et al.
6,076,046 A 6/2000 Vasudevan et al.
6,079,499 A 6/2000 Mikus et al.
6,216,783 B1 4/2001 Hocking et al.
6,318,464 B1 11/2001 Mokrys
6,360,819 B1 3/2002 Vinegar
6,372,678 B1 * 4/2002 Youngman et al. ..... 501/128
6,412,557 B1 7/2002 Ayasse et al.
6,443,227 B1 * 9/2002 Hocking et al. ..... 166/250.1
6,591,908 B2 7/2003 Nasr
6,708,759 B2 3/2004 Leaute et al.
6,722,431 B2 4/2004 Karanikas et al.
6,769,486 B2 8/2004 Lim et al.
6,883,607 B2 4/2005 Nenniger et al.
6,991,037 B2 1/2006 Hocking

* cited by examiner

ENHANCED HYDROCARBON RECOVERY BY IN SITU COMBUSTION OF OIL SAND FORMATIONS

RELATED APPLICATION

This application is a continuation-in-part of U.S. patent application Ser. No. 11/363,540, filed Feb. 27, 2006, U.S. patent application Ser. No. 11/277,308, filed Mar. 23, 2006, now abandoned, U.S. patent application Ser. No. 11/277,775, filed Mar. 29, 2006, now abandoned, U.S. patent application Ser. No. 11/277,815, filed Mar. 29, 2006, now abandoned, U.S. patent application Ser. No. 11/277,789, filed Mar. 29, 2006, now abandoned, U.S. patent application Ser. No. 11/278,470, filed Apr. 3, 2006, now abandoned, and U.S. patent application Ser. No. 11/379,123, filed Apr. 18, 2006, now abandoned.

TECHNICAL FIELD

The present invention generally relates to the enhanced recovery of petroleum fluids from the subsurface by the injection of an oxygen enriched gas into the oil sand formation for in situ combustion of the viscous heavy oil and bitumen in situ, and more particularly to a method and apparatus to extract a particular fraction of the in situ hydrocarbon reserve by controlling the access to the in situ bitumen, the rate and growth of the combustion front, the flue gas composition, the flow of produced hydrocarbons through a hot zone containing a catalyst for promoting in situ hydrodesulfurization and thermal cracking, the operating reservoir pressures of the in situ process, thus resulting in increased production and quality of the produced petroleum fluids from the subsurface formation as well as limiting water inflow into the process zone.

BACKGROUND OF THE INVENTION

Heavy oil and bitumen oil sands are abundant in reservoirs in many parts of the world such as those in Alberta, Canada, Utah and California in the United States, the Orinoco Belt of Venezuela, Indonesia, China, and Russia. The hydrocarbon reserves of the oil sand deposit is extremely large in the trillions of barrels, with recoverable reserves estimated by current technology in the 300 billion barrels for Alberta, Canada and a similar recoverable reserve for Venezuela. These vast heavy oil (defined as the liquid petroleum resource of less than 20° API gravity) deposits are found largely in unconsolidated sandstones, being high porosity permeable cohensionless sands with minimal grain to grain cementation. The hydrocarbons are extracted from the oils sands either by mining or in situ methods.

The heavy oil and bitumen in the oil sand deposits have high viscosity at reservoir temperatures and pressures. While some distinctions have arisen between tar and oil sands and between bitumen and heavy oil, these terms will be used interchangeably herein. The oil sand deposits in Alberta, Canada extend over many square miles and vary in thickness up to hundreds of feet thick. Although some of these deposits lie close to the surface and are suitable for surface mining, the majority of the deposits are at depth ranging from a shallow depth of 150 feet down to several thousands of feet below ground surface. The oil sands located at these depths constitute some of the world's largest presently known petroleum deposits. The oil sands contain a viscous hydrocarbon material, commonly referred to as bitumen, in an amount that ranges up to 15% by weight. Bitumen is effectively immobile at typical reservoir temperatures. For example at 15° C., bitumen has a viscosity of ~1,000,000 centipoise. However at elevated temperatures the bitumen viscosity changes considerably to be ~350 centipoise at 100° C. down to ~10 centipoise at 180° C. The oil sand deposits have an inherently high permeability ranging from ~1 to 10 Darcy, thus upon heating, the heavy oil becomes mobile and can easily drain from the deposit.

In situ methods of hydrocarbon extraction from the oil sands consist of cold production, in which the less viscous petroleum fluids are extracted from vertical and horizontal wells with sand exclusion screens, CHOPS (cold heavy oil production system) cold production with sand extraction from vertical and horizontal wells with large diameter perforations thus encouraging sand to flow into the well bore, CSS (cyclic steam stimulation) a huff and puff cyclic steam injection system with gravity drainage of heated petroleum fluids using vertical and horizontal wells, streamflood using injector wells for steam injection and producer wells on 5 and 9 point layout for vertical wells and combinations of vertical and horizontal wells, SAGD (steam assisted gravity drainage) steam injection and gravity production of heated hydrocarbons using two horizontal wells, VAPEX (vapor assisted petroleum extraction) solvent vapor injection and gravity production of diluted hydrocarbons using horizontal wells, and the THAI (toe heel air injection), a vertical injector well located near the base of a horizontal producer well for an in situ combustion process, and combinations of these methods.

Cyclic steam stimulation and steamflood hydrocarbon enhanced recovery methods have been utilized worldwide, beginning in 1956 with the discovery of CSS, huff and puff or steam-soak in Mene Grande field in Venezuela and for steamflood in the early 1960s in the Kern River field in California. These steam assisted hydrocarbon recovery methods including a combination of steam and solvent are described, see U.S. Pat. No. 3,739,852 to Woods et al, U.S. Pat. No. 4,280,559 to Best, U.S. Pat. No. 4,519,454 to McMillen, U.S. Pat. No. 4,697,642 to Vogel, and U.S. Pat. No. 6,708,759 to Leaute et al. The CSS process raises the steam injection pressure above the formation fracturing pressure to create fractures within the formation and enhance the surface area access of the steam to the bitumen. Successive steam injection cycles reenter earlier created fractures and thus the process becomes less efficient over time. CSS is generally practiced in vertical wells, but systems are operational in horizontal wells, but have complications due to localized fracturing and steam entry and the lack of steam flow control along the long length of the horizontal well bore.

Descriptions of the SAGD process and modifications are described, see U.S. Pat. No. 4,344,485 to Butler, and U.S. Pat. No. 5,215,146 to Sanchez and thermal extraction methods in U.S. Pat. No. 4,085,803 to Butler, U.S. Pat. No. 4,099,570 to Vandergrift, and U.S. Pat. No. 4,116,275 to Butler et al. The SAGD process consists of two horizontal wells at the bottom of the hydrocarbon formation, with the injector well located approximately 10-15 feet vertically above the producer well. The steam injection pressures exceed the formation fracturing pressure in order to establish connection between the two wells and develop a steam chamber in the oil sand formation. Similar to CSS, the SAGD method has complications, albeit less severe than CSS, due to the lack of steam flow control along the long section of the horizontal well and the difficulty of controlling the growth of the steam chamber.

A thermal steam extraction process referred to a HASDrive (heated annulus steam drive) and modifications thereof are described to heat and hydrogenate the heavy oils insitu in the presence of a metal catalyst, see U.S. Pat. No. 3,994,340 to Anderson et al, U.S. Pat. No. 4,696,345 to Hsuch, U.S. Pat.

No. 4,706,751 to Gondouin, U.S. Pat. No. 5,054,551 to Duerksen, and U.S. Pat. No. 5,145,003 to Duerksen. It is disclosed that at elevated temperature and pressure the injection of hydrogen or a combination of hydrogen and carbon monoxide to the heavy oil in situ in the presence of a metal catalyst will hydrogenate and thermal crack at least a portion of the petroleum in the formation.

Thermal recovery processes using steam require large amounts of energy to produce the steam, using either natural gas or heavy fractions of produced synthetic crude. Burning these fuels generates significant quantities of greenhouse gases, such as carbon dioxide. Also, the steam process uses considerable quantities of water, which even though may be reprocessed, involves recycling costs and energy use. Therefore a less energy intensive oil recovery process is desirable.

Solvents applied to the bitumen soften the bitumen and reduce its viscosity and provide a non-thermal mechanism to improve the bitumen mobility. Hydrocarbon solvents consist of vaporized light hydrocarbons such as ethane, propane, or butane or liquid solvents such as pipeline diluents, natural condensate streams, or fractions of synthetic crudes. The diluent can be added to steam and flashed to a vapor state or be maintained as a liquid at elevated temperature and pressure, depending on the particular diluent composition. While in contact with the bitumen, the saturated solvent vapor dissolves into the bitumen. This diffusion process is due to the partial pressure difference in the saturated solvent vapor and the bitumen. As a result of the diffusion of the solvent into the bitumen, the oil in the bitumen becomes diluted and mobile and will flow under gravity. The resultant mobile oil may be deasphalted by the condensed solvent, leaving the heavy asphaltenes behind within the oil sand pore space with little loss of inherent fluid mobility in the oil sands due to the small weight percent (5-15%) of the asphaltene fraction to the original oil in place. Deasphalting the oil from the oil sands produces a high grade quality product by 3°-5° API gravity. If the reservoir temperature is elevated the diffusion rate of the solvent into the bitumen is raised considerably being two orders of magnitude greater at 100° C. compared to ambient reservoir temperatures of ~15° C.

Solvent assisted recovery of hydrocarbons in continuous and cyclic modes are described including the VAPEX process and combinations of steam and solvent plus heat, see U.S. Pat. No. 4,450,913 to Allen et al, U.S. Pat. No. 4,513,819 to Islip et al, U.S. Pat. No. 5,407,009 to Butler et al, U.S. Pat. No. 5,607,016 to Butler, U.S. Pat. No. 5,899,274 to Frauenfeld et al, U.S. Pat. No. 6,318,464 to Mokrys, U.S. Pat. No. 6,769,486 to Lim et al, and U.S. Pat. No. 6,883,607 to Nenniger et al. The VAPEX process generally consists of two horizontal wells in a similar configuration to SAGD; however, there are variations to this including spaced horizontal wells and a combination of horizontal and vertical wells. The startup phase for the VAPEX process can be lengthy and take many months to develop a controlled connection between the two wells and avoid premature short circuiting between the injector and producer. The VAPEX process with horizontal wells has similar issues to CSS and SAGD in horizontal wells, due to the lack of solvent flow control along the long horizontal well bore, which can lead to non-uniformity of the vapor chamber development and growth along the horizontal well bore.

Direct heating and electrical heating methods for enhanced recovery of hydrocarbons from oil sands have been disclosed in combination with steam, hydrogen, catalysts, and/or solvent injection at temperatures to ensure the petroleum fluids gravity drain from the formation and at significantly higher temperatures (300° to 400° range and above) to pyrolysis the oil sands. See U.S. Pat. No. 2,780,450 to Ljungström, U.S. Pat. No. 4,597,441 to Ware et al, U.S. Pat. No. 4,926,941 to Glandt et al, U.S. Pat. No. 5,046,559 to Glandt, U.S. Pat. No. 5,060,726 to Glandt et al, U.S. Pat. No. 5,297,626 to Vinegar et al, U.S. Pat. No. 5,392,854 to Vinegar et al, and U.S. Pat. No. 6,722,431 to Karanikas et al In situ combustion processes have been disclosed. See U.S. Pat. No. 4,454,916 to Shu, U.S. Pat. No. 4,474,237 to Shu, U.S. Pat. No. 4,566,536 to Holmes et al, U.S. Pat. No. 4,598,770 to Shu et al, U.S. Pat. No. 4,625,800 to Venkatesan, U.S. Pat. No. 4,993,490 to Stephens et al, U.S. Pat. No. 5,211,230 to Ostapovich et al, U.S. Pat. No. 5,273,111 to Brannan et al, U.S. Pat. No. 5,339,897 to Leaute, U.S. Pat. No. 5,413,224 to Laali, U.S. Pat. No. 5,626,191 to Greaves et al, U.S. Pat. No. 5,824,214 to Paul et al, U.S. Pat. No. 5,871,637 to Brons, U.S. Pat. No. 5,954,946 to Klazinga et al, and U.S. Pat. No. 6,412,557 to Ayasse et al. Many of these disclosed methods involve in situ combustion of the in situ hydrocarbon deposit with a combination of vertical and horizontal wells. The process involves the injection of an oxygen rich injection gas, igniting the in situ hydrocarbons, either by direct ignition from a standard downhole burner, or from self ignition, and drawing the produced flue gas off to create a gas pressure gradient to control the rate and progress of the combustion front. The difficulties experienced by the various disclosed methods are: 1) initiating connection of the injector, the combustion zone, and producer to get the process started, 2) the potential for a liquid and/or gravity block, i.e. mobile hydrocarbons can not flow to the producer or combustion (flue) gases rise vertically rather than flow to the producer, and 3) the difficulty of raising the temperature of the produced hydrocarbons to initiate some form of hydrodesulfurization and/or thermal cracking. Some of the disclosed processes overcome some of these difficulties by heating a zone and thus connecting the injector and producer prior to injection of the oxygen rich gas injection and ignition of the hydrocarbon formation. Other methods force the produced hydrocarbons to flow through a spent previously combusted zone to raise the temperature to induce some form of cracking process, while others propose placement of a catalyst in the producer well to promote further cracking at the elevated temperatures. The THAI (toe heel air injection) combustion process has been demonstrated in laboratory tests for application to oil sands, involving air injection in a vertical well with the producer being a horizontal well at a deeper depth and the combustion front progressing horizontally along the alignment of the producer and downwards towards the producer.

In situ processes involving downhole heaters are described in U.S. Pat. No. 2,634,961 to Ljungström, U.S. Pat. No. 2,732,195 to Ljungström, U.S. Pat. No. 2,780,450 to Ljungström. Electrical heaters are described for heating viscous oils in the forms of downhole heaters and electrical heating of tubing and/or casing, see U.S. Pat. No. 2,548,360 to Germain, U.S. Pat. No. 4,716,960 to Eastlund et al, U.S. Pat. No. 5,060,287 to Van Egmond, U.S. Pat. No. 5,065,818 to Van Egmond, U.S. Pat. No. 6,023,554 to Vinegar and U.S. Pat. No. 6,360,819 to Vinegar. Flameless downhole combustor heaters are described, see U.S. Pat. No. 5,255,742 to Mikus, U.S. Pat. No. 5,404,952 to Vinegar et al, U.S. Pat. No. 5,862,858 to Wellington et al, and U.S. Pat. No. 5,899,269 to Wellington et al. Surface fired heaters or surface burners may be used to heat a heat transferring fluid pumped downhole to heat the formation as described in U.S. Pat. No. 6,056,057 to Vinegar et al and U.S. Pat. No. 6,079,499 to Mikus et al.

The thermal and solvent methods of enhanced oil recovery from oil sands, all suffer from a lack of surface area access to the in place bitumen. Thus the reasons for raising steam pressures above the fracturing pressure in CSS and during steam chamber development in SAGD, are to increase surface area of the steam with the in place bitumen. Similarly the VAPEX process is limited by the available surface area to the in place bitumen, because the diffusion process at this contact controls the rate of softening of the bitumen. Likewise during steam chamber growth in the SAGD process the contact surface area with the in place bitumen is virtually a constant, thus limiting the rate of heating of the bitumen. Therefore, the methods, heat and solvent, or a combination thereof, would greatly benefit from a substantial increase in contact surface area with the in place bitumen. Hydraulic fracturing of low permeable reservoirs has been used to increase the efficiency of such processes and CSS methods involving fracturing are described in U.S. Pat. No. 3,739,852 to Woods et al, U.S. Pat. No. 5,297,626 to Vinegar et al, and U.S. Pat. No. 5,392,854 to Vinegar et al. Also during initiation of the SAGD process, overpressurized conditions are usually imposed to accelerated the steam chamber development, followed by a prolonged period of underpressurized condition to reduce the steam to oil ratio. Maintaining reservoir pressure during heating of the oil sands has the significant benefit of minimizing water inflow to the heated zone and to the well bore.

In situ combustion methods all suffer from poor connection between the injected gas location, combustion zone, and producer especially at initiation, and during propagation and growth of the combustion front if barren or shale lenses are present or if the oil sands have intrinsically low vertical permeability. The in situ combustion method would benefit greatly from having good connection between the injected gas location, combustion zone, and the producer both at the initiation configuration and throughout the propagation and growth of the combustion front. Highly permeable vertical propped hydraulic fractures extending radially from the injector would greatly benefit the process by providing a connection to control the rate and growth of the combustion front and thus guide the combustion front radially between the propped fracture system.

Hydraulic fracturing of petroleum recovery wells enhances the extraction of fluids from low permeable formations due to the high permeability of the induced fracture and the size and extent of the fracture. A single hydraulic fracture from a well bore results in increased yield of extracted fluids from the formation. Hydraulic fracturing of highly permeable unconsolidated formations has enabled higher yield of extracted fluids from the formation and also reduced the inflow of formation sediments into the well bore. Typically the well casing is cemented into the bore hole, and the casing perforated with shots of generally 0.5 inches in diameter over the depth interval to be fractured. The formation is hydraulically fractured by injecting the fracture fluid into the casing, through the perforations, and into the formation. The hydraulic connectivity of the hydraulic fracture or fractures formed in the formation may be poorly connected to the well bore due to restrictions and damage due to the perforations. Creating a hydraulic fracture in the formation that is well connected hydraulically to the well bore will increase the yield from the well, result in less inflow of formation sediments into the well bore, and result in greater recovery of the petroleum reserves from the formation.

Turning now to the prior art, hydraulic fracturing of subsurface earth formations to stimulate production of hydrocarbon fluids from subterranean formations has been carried out in many parts of the world for over fifty years. The earth is hydraulically fractured either through perforations in a cased well bore or in an isolated section of an open bore hole. The horizontal and vertical orientation of the hydraulic fracture is controlled by the compressive stress regime in the earth and the fabric of the formation. It is well known in the art of rock mechanics that a fracture will occur in a plane perpendicular to the direction of the minimum stress, see U.S. Pat. No. 4,271,696 to Wood. At significant depth, one of the horizontal stresses is generally at a minimum, resulting in a vertical fracture formed by the hydraulic fracturing process. It is also well known in the art that the azimuth of the vertical fracture is controlled by the orientation of the minimum horizontal stress in consolidated sediments and brittle rocks.

At shallow depths, the horizontal stresses could be less or greater than the vertical overburden stress. If the horizontal stresses are less than the vertical overburden stress, then vertical fractures will be produced; whereas if the horizontal stresses are greater than the vertical overburden stress, then a horizontal fracture will be formed by the hydraulic fracturing process.

Hydraulic fracturing generally consists of two types, propped and unpropped fracturing. Unpropped fracturing consists of acid fracturing in carbonate formations and water or low viscosity water slick fracturing for enhanced gas production in tight formations. Propped fracturing of low permeable rock formations enhances the formation permeability for ease of extracting petroleum hydrocarbons from the formation. Propped fracturing of high permeable formations is for sand control, i.e. to reduce the inflow of sand into the well bore, by placing a highly permeable propped fracture in the formation and pumping from the fracture thus reducing the pressure gradients and fluid velocities due to draw down of fluids from the well bore. Hydraulic fracturing involves the literally breaking or fracturing the rock by injecting a specialized fluid into the well bore passing through perforations in the casing to the geological formation at pressures sufficient to initiate and/or extend the fracture in the formation. The theory of hydraulic fracturing utilizes linear elasticity and brittle failure theories to explain and quantify the hydraulic fracturing process. Such theories and models are highly developed and generally sufficient for the art of initiating and propagating hydraulic fractures in brittle materials such as rock, but are totally inadequate in the understanding and art of initiating and propagating hydraulic fractures in ductile materials such as unconsolidated sands and weakly cemented formations.

Hydraulic fracturing has evolved into a highly complex process with specialized fluids, equipment and monitoring systems. The fluids used in hydraulic fracturing vary depending on the application and can be water, oil, or multi-phased based gels. Aqueous based fracturing fluids consist of a polymeric gelling agent such as solvatable (or hydratable) polysaccharide, e.g. galactomannan gums, glycomannan gums, and cellulose derivatives. The purpose of the hydratable polysaccharides is to thicken the aqueous solution and thus act as viscosifiers, i.e. increase the viscosity by 100 times or more over the base aqueous solution. A cross-linking agent can be added which further increases the viscosity of the solution. The borate ion has been used extensively as a cross-linking agent for hydrated guar gums and other galactomannans, see U.S. Pat. No. 3,059,909 to Wise. Other suitable cross-linking agents are chromium, iron, aluminum, zirconium (see U.S. Pat. No. 3,301,723 to Chrisp), and titanium (see U.S. Pat. No. 3,888,312 to Tiner et al). A breaker is added to the solution to controllably degrade the viscous fracturing fluid. Common breakers are enzymes and catalyzed oxidizer breaker systems, with weak organic acids sometimes used.

Oil based fracturing fluids are generally based on a gel formed as a reaction product of aluminum phosphate ester and a base, typically sodium aluminate. The reaction of the ester and base creates a solution that yields high viscosity in diesels or moderate to high API gravity hydrocarbons. Gelled hydrocarbons are advantageous in water sensitive oil producing formations to avoid formation damage that would otherwise be caused by water based fracturing fluids.

The method of controlling the azimuth of a vertical hydraulic fracture in formations of unconsolidated or weakly cemented soils and sediments by slotting the well bore or installing a pre-slotted or weakened casing at a predetermined azimuth has been disclosed. The method disclosed that a vertical hydraulic fracture can be propagated at a pre-determined azimuth in unconsolidated or weakly cemented sediments and that multiple orientated vertical hydraulic fractures at differing azimuths from a single well bore can be initiated and propagated for the enhancement of petroleum fluid production from the formation. See U.S. Pat. No. 6,216,783 to Hocking et al, U.S. Pat. No. 6,443,227 to Hocking et al, U.S. Pat. No. 6,991,037 to Hocking, and Hocking U.S. patent application Ser. Nos. 11/363,540, 11/277,308, 11/277,775, 11/277,815, and 11/277,789. The method disclosed that a vertical hydraulic fracture can be propagated at a pre-determined azimuth in unconsolidated or weakly cemented sediments and that multiple orientated vertical hydraulic fractures at differing azimuths from a single well bore can be initiated and propagated for the enhancement of petroleum fluid production from the formation. It is now known that unconsolidated or weakly cemented sediments behave substantially different from brittle rocks from which most of the hydraulic fracturing experience is founded.

Accordingly, there is a need for a method and apparatus for enhancing the extraction of hydrocarbons from oil sands by in situ combustion, direct heating, steam, and/or solvent injection or a combination thereof and controlling the subsurface environment, both temperature and pressure, to optimize the hydrocarbon extraction in terms of produced rate, efficiency, and produced product quality, as well as limit water inflow into the process zone.

SUMMARY OF THE INVENTION

The present invention is a method and apparatus for the enhanced recovery of petroleum fluids from the subsurface by in situ combustion of the hydrocarbon deposit, by injecting an oxygen rich gas, and by drawing off a flue gas to control the rate and progation of the combustion front to be predominantly radially away from the well bore and downwards to the bottom of the well bore, from which the produced flue gas and hydrocarbons are extracted. Multiple propped hydraulic fractures are constructed from the well bore into the oil sand formation and filled with a highly permeable proppant. The oxygen rich gas is injected via the well bore into the top of the propped fractures, the in situ hydrocarbons are ignited by a downhole burner, and the generated flue gas are extracted from the bottom of the propped fractures through the well bore. A mobile oil zone forms in front of the combustion front, and the oil, under the influence of gravity, drains through the propped fractures to the bottom of the well bore and is pumped to the surface. The injection gas is injected into the well bore and into the propped fractures at or near the ambient reservoir pressure but substantially below the reservoir fracturing pressure. The flue gas is extracted at a rate to control the propagation and shape of the combustion front and the resultant oxygen content of the flue gas. The predominantly horizontal combustion front propagates vertically downwards contacting the oil sands and in situ bitumen between the vertical faces of the propped fractures. The combustion front is predominantly horizontal, providing good vertical sweep and advances vertically downwards with good lateral sweep, due to the flue gas exhaust control provided by the highly permeable propped fractures. Basically the combustion front is guided by the radially entending vertical hydraulic fractures. The flue gas is composed of combustion gases consisting of carbon monoxide, carbon dioxide, sulfur dioxide, and water vapor.

The combustion front generates significant heat, which diffuses into the bitumen ahead of the combustion front and heats the bitumen sufficient for mobile oil to flow under gravity. The bitumen softens and flows by gravity through the oil sands and the propped fractures to the well bore. The generated flue gases and produced hydrocarbons flow down the propped fractures to the well bore heating the proppant in the process. The vertical downward growth of the combustion front consumes the in situ hydrocarbons between the hydraulic fractures as it propagates downwards. Thus the proppant in the lower portions of the propped fractures have been significantly heated by the passage of the combustion gases and thus are at sufficiently high a temperature to induce thermal cracking of the cooler produced hydrocarbons draining by gravity through this hot zone to the well bore. A catalyst placed as the proppant in the fractures or placed in a canister in the well bore will further promote hydrodesulfurization and thermal cracking and thus upgrade in situ the quality of the produced hydrocarbon product. Such catalysts are really available as HDS (hydrodesulfurization) metal containing catalysts and FCC (fluid catalytic cracking) rare earth aluminum silica catalysts.

The in situ produced hydrocarbon product and flue gas are extracted from the bottom section of the well bore, with the rate of flue gas extraction controlling the rate and growth of the combustion front and the resultant oxygen content of the flue gas. The injected gas could be air or an enriched oxygen injected gas to limit degrading influences that air injection has on the resulting the mobilized oil's viscosity. The process can operate close to ambient reservoir pressures, so that water inflow into the process zone can be minimized. Catalysts for hydrodesulfurization and thermal cracking are contained in the proppant of the hydraulic fractures or within a canister in the well bore. The proppant zone in the lower portions of the hydraulic fractures will be raised to high temperatures as the combustion gases pass through this zone. Therefore the produced hydrocarbons will flow through this hot zone and thus the catalysts will promote upgrading of the mobile oil by hydrodesulfurization and thermal cracking of some portions of the produced hydrocarbon.

Although the present invention contemplates the formation of fractures which generally extend laterally away from a vertical or near vertical well penetrating an earth formation and in a generally vertical plane, those skilled in the art will recognize that the invention may be carried out in earth formations wherein the fractures and the well bores can extend in directions other than vertical.

Therefore, the present invention provides a method and apparatus for enhanced recovery of petroleum fluids from the subsurface by the injection of an oxygen enriched gas in the oil sand formation for the in situ combustion of the viscous heavy oil and bitumen in situ, and more particularly to a method and apparatus to extract a particular fraction of the in situ hydrocarbon reserve by controlling the access to the in situ bitumen, by controlling the rate and growth of the combustion front, by controlling the flue gas composition, by controlling the flow of produced hydrocarbons through a hot zone containing a catalyst for promoting in situ hydrodesulfurization and thermal cracking, and by controlling the operating reservoir pressures of the in situ process, thus resulting in increased production and quality of the produced petroleum fluids from the subsurface formation as well as limiting water inflow into the process zone.

Other objects, features and advantages of the present invention will become apparent upon reviewing the following description of the preferred embodiments of the invention, when taken in conjunction with the drawings and the claims.

DETAILED DESCRIPTION OF THE DISCLOSED EMBODIMENT

Several embodiments of the present invention are described below and illustrated in the accompanying drawings. The present invention is a method and apparatus for the enhanced recovery of petroleum fluids from the subsurface by in situ combustion of the hydrocarbon deposit, by injecting an oxygen rich gas, and by drawing off a flue gas to control the rate and progation of the predominantly horizontal combustion front to be vertically downwards. Multiple propped hydraulic fractures are constructed from the well bore into the oil sand formation and filled with a highly permeable proppant. The oxygen rich gas is injected via the well bore into the top of the propped fractures, the in situ hydrocarbons are ignited by a downhole burner, the generated flue gas is extracted from the bottom of the propped fractures through the well bore, and the mobile oil drains by gravity through the propped fractures to the bottom of the well bore and is pumped to the surface. The combustion front is predominantly horizontal, providing good vertical sweep and advances vertically downwards with good lateral sweep, due to the flue gas exhaust control provided by the highly permeable propped vertical fractures.

Figure 1:
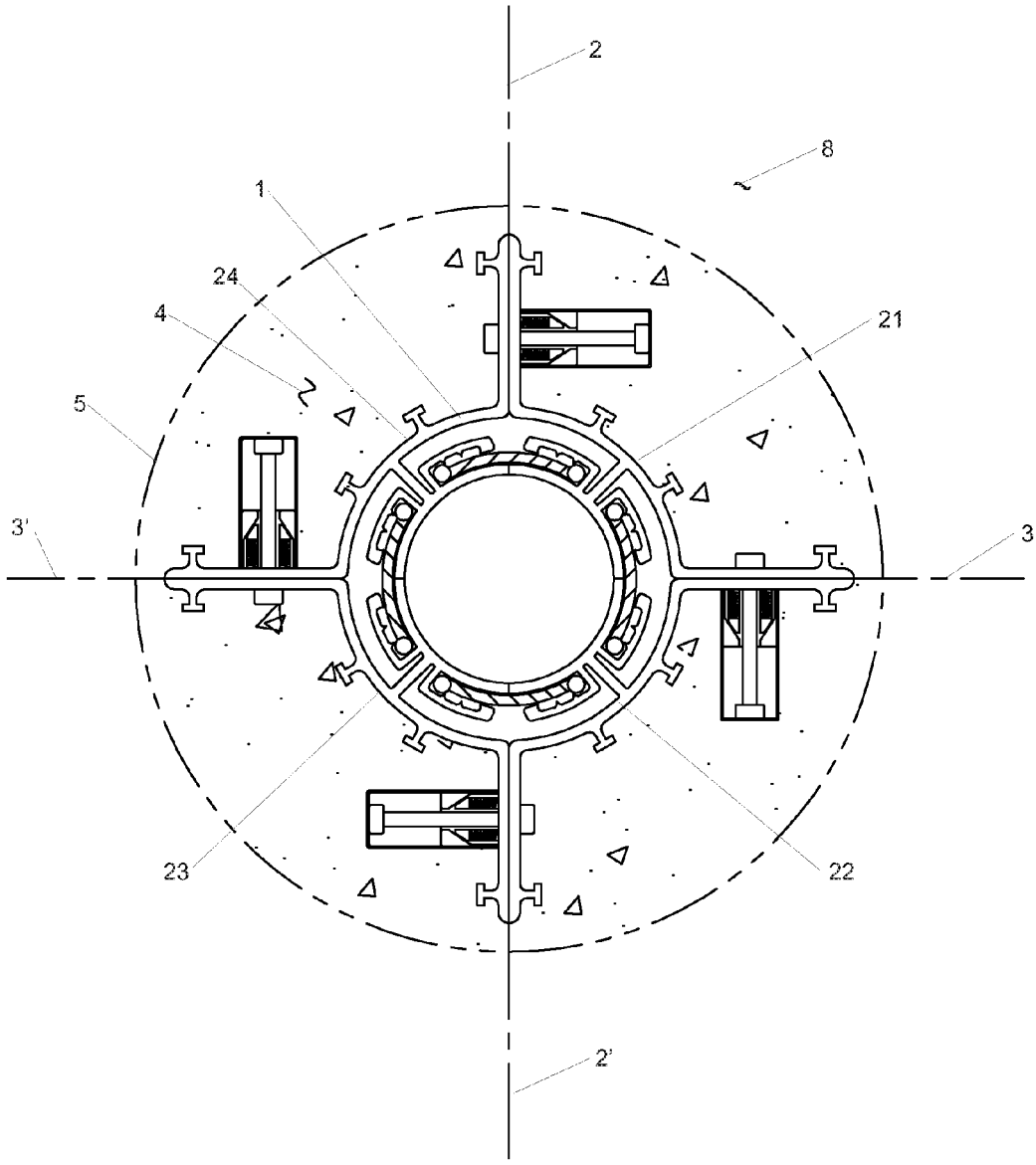
FIG. 1 is a horizontal cross-section view of a well casing having dual fracture winged initiation sections prior to initiation of multiple azimuth controlled vertical fractures.
Figure 2:
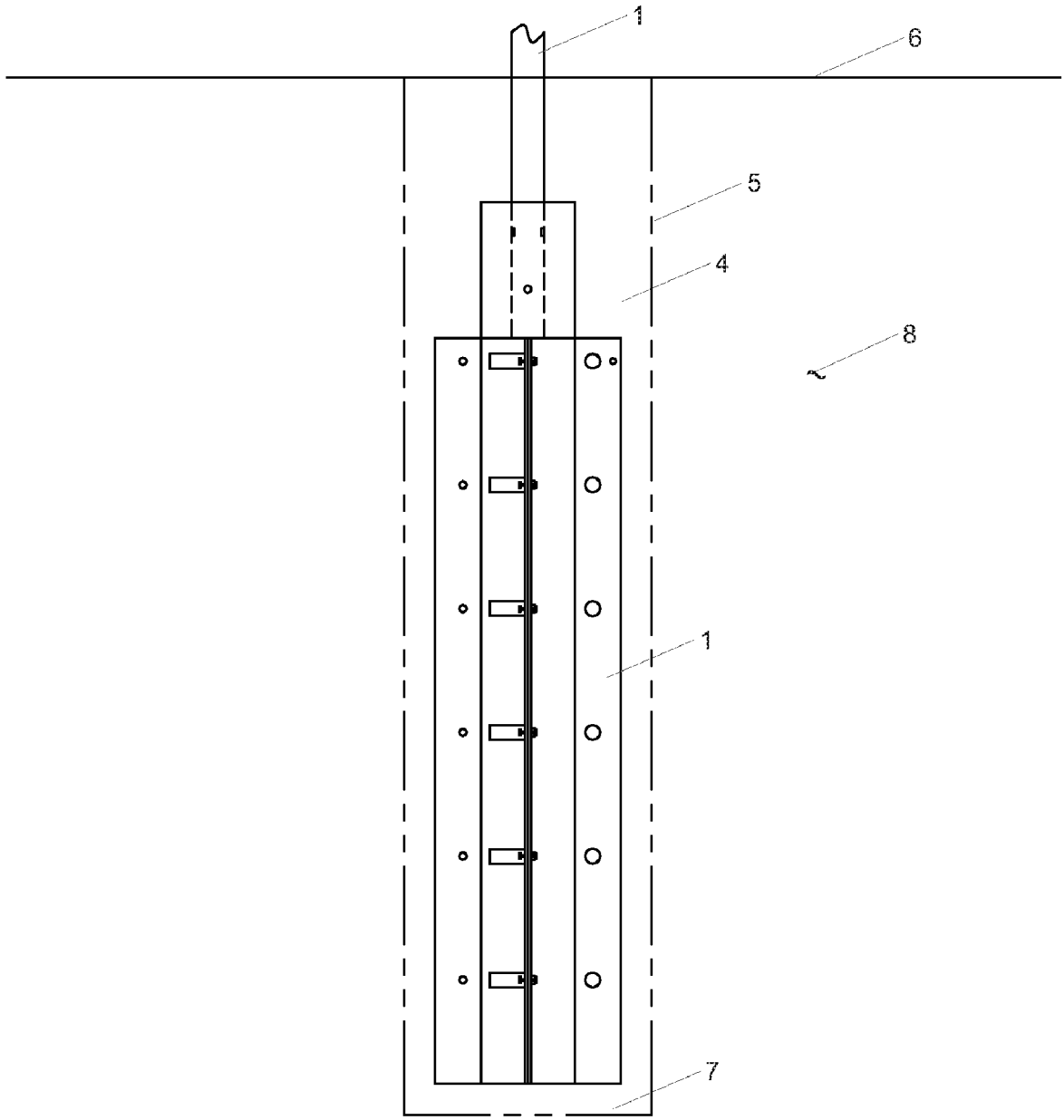
FIG. 2 is a cross-sectional side elevation view of a well casing having dual fracture winged initiation sections prior to initiation of multiple azimuth controlled vertical fractures.

Referring to the drawings, in which like numerals indicate like elements, FIGS. 1 and 2 illustrate the initial setup of the method and apparatus for forming an in situ combustion enhanced recovery system of the oil sand deposit, for the extraction of in situ upgraded processed hydrocarbon fluids. Conventional bore hole 5 is completed by wash rotary or cable tool methods into the formation 8 to a predetermined depth 7 below the ground surface 6. Injection casing 1 is installed to the predetermined depth 7, and the installation is completed by placement of a grout 4 which completely fills the annular space between the outside the injection casing 1 and the bore hole 5. Injection casing 1 consists of four initiation sections 21, 22, 23, and 24 to produce two fractures, one orientated along plane 2, 2' and one orientated along plane 3, 3'. Injection casing 1 must be constructed from a material that can withstand the pressures that the fracture fluid exerts upon the interior of the injection casing 1 during the pressurization of the fracture fluid and the elevated temperatures imposed by the combustion process. The grout 4 is a special purpose cement for high temperature that preserves the spacing between the exterior of the injection casing 1 and the bore hole 5 throughout the fracturing procedure and in situ combustion process, preferably being a non-shrink or low shrink cement based grout that can withstand the imposed temperatures and differential strains.

The outer surface of the injection casing 1 should be roughened or manufactured such that the grout 4 bonds to the injection casing 1 with a minimum strength equal to the down hole pressure required to initiate the controlled vertical fracture. The bond strength of the grout 4 to the outside surface of the casing 1 prevents the pressurized fracture fluid from short circuiting along the casing-to-grout interface up to the ground surface 6.

Figure 3:
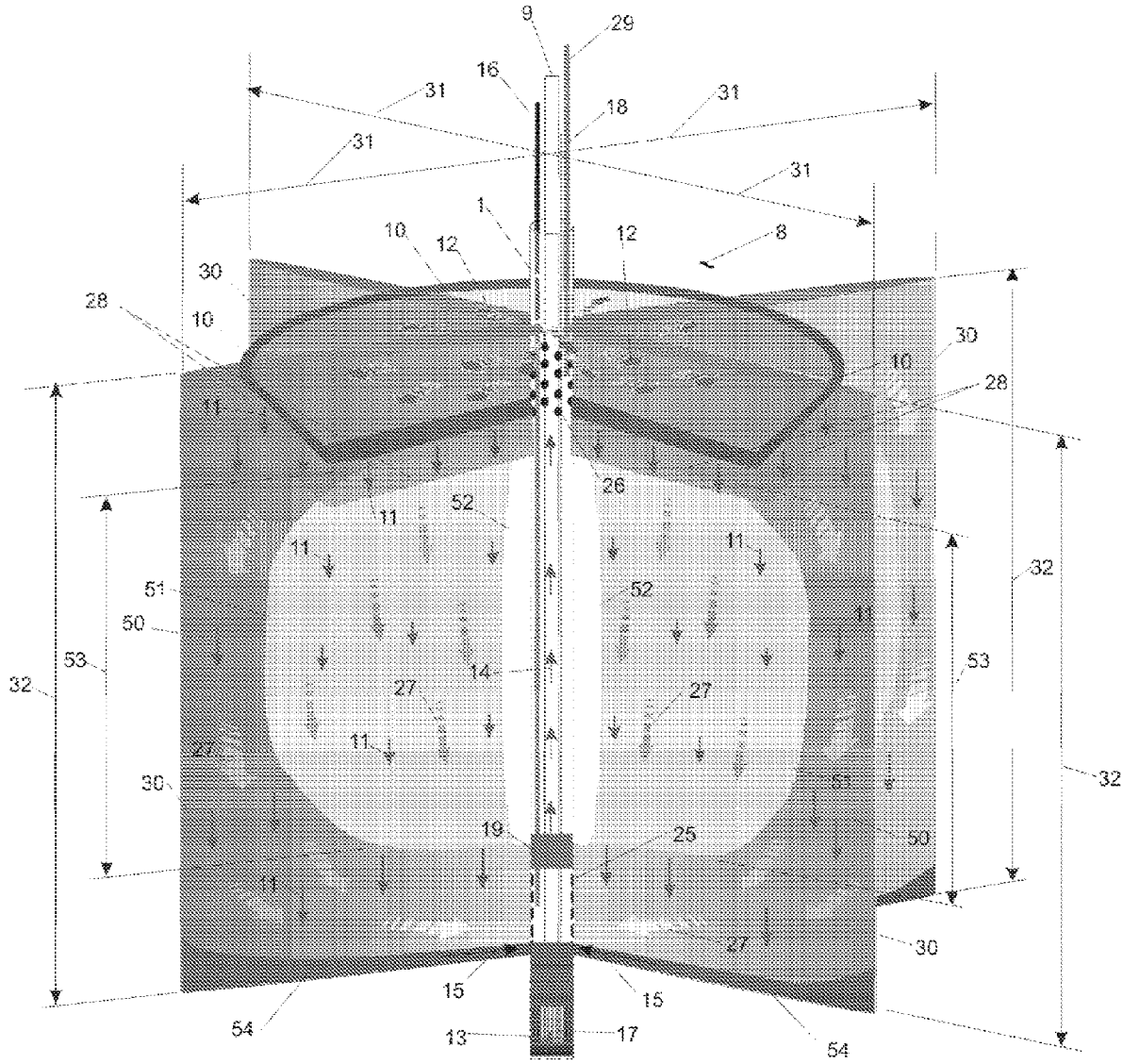
FIG. 3 is an isometric view of a well casing having dual propped fractures with downhole injected oxygen enriched gas, combustion front, and gravity flow of produced hydrocarbons.

Referring to FIGS. 1, 2, and 3, the injection casing 1 comprises two fracture dual winged initiation sections 21, 22, 23, and 24 installed at a predetermined depth 7 within the bore hole 5. The winged initiation sections 21, 22, 23, and 24 can be constructed from the same material as the injection casing 1. The position below ground surface of the winged initiation sections 21, 22, 23, and 24 will depend on the required in situ geometry of the induced hydraulic fractures and the reservoir formation properties and recoverable reserves.

The hydraulic fractures will be initiated and propagated by an oil based fracturing fluid consisting of a gel formed as a reaction product of aluminum phosphate ester and a base, typically sodium aluminate. The reaction of the ester and base creates a solution that yields high viscosity in diesels or moderate to high API gravity hydrocarbons. Gelled hydrocarbons are advantageous in water sensitive oil producing formations to avoid formation damage, that would otherwise be caused by water based fracturing fluids. Alternatively a water based fracturing fluid gel can be used.

The pumping rate of the fracturing fluid and the viscosity of the fracturing fluid needs to be controlled to initiate and propagate the fracture in a controlled manner in weakly cemented sediments such as oil sands. The dilation of the casing and grout imposes a dilation of the formation that generates an unloading zone in the oil sand, and such dilation of the formation reduces the pore pressure in the formation in front of the fracturing tip. The variables of interest are v the velocity of the fracturing fluid in the throat of the fracture, i.e. the fracture propagation rate, w the width of the fracture at its throat, being the casing dilation at fracture initiation, and $\mu$ the viscosity of the fracturing fluid at the shear rate in the fracture throat. The Reynolds number is $Re=\rho vw/\mu$. To ensure a repeatable single orientated hydraulic fracture is formed, the formation needs to be dilated orthogonal to the intended fracture plane, and the fracturing fluid pumping rate needs to be limited so that the Re is less than 100 during fracture initiation and less than 250 during fracture propagation. Also if the fracturing fluid can flow into the dilatant zone in the formation ahead of the fracture and negate the induce pore pressure from formation dilation then the fracture will not propagate along the intended azimuth. In order to ensure that the fracturing fluid does not negate the pore pressure gradients in front of the fracture tip, its viscosity, at fracturing shear rates within the fracture throat of ~1-20 $sec^{-1}$, needs to be greater than 100 centipoise.

The fracture fluid forms a highly permeable hydraulic fracture by placing a proppant in the fracture to create a highly permeable fracture. Such proppants are typically clean sand for large massive hydraulic fracture installations or specialized manufactured particles (generally resin coated sand or ceramic in composition) that are designed also to limit flow back of the proppant from the fracture into the well bore. Due to the high temperatures experienced by the proppant during the combustion process, the proppant material will be specially selected to be temperature compatible with the process and consist of clean strong sands, ceramic beads, HDS and FCC catalysts, or a mixture thereof. The fracture fluid-gel-proppant mixture is injected into the formation and carries the proppant to the extremes of the fracture. Upon propagation of the fracture to the required lateral extent 31 and vertical extent 32, the predetermined fracture thickness may need to be increased by utilizing the process of tip screen out or by re-fracturing the already induced fractures. The tip screen out process involves modifying the proppant loading and/or fracture fluid properties to achieve a proppant bridge at the fracture tip. The fracture fluid is further injected after tip screen out, but rather then extending the fracture laterally or vertically, the injected fluid widens, i.e. thickens, and fills the fracture from the fracture tip back to the well bore. Multi-stage fracturing involves injecting a proppant to form a hydraulic fracture 30 as shown as proppant material 50 (FIG. 3). Prior to creation of the full fracture extent, however, a different proppant material is injected into the fracture over a reduced central section of the well bore 53 to create an area of the hydraulic fracture 51 loaded with a different proppant material. Similarly the multi-stage fracturing could consist of a third stage by injecting a different proppant material as shown by 52. The purpose of injecting differing proppant materials is to select proppants of differing permeability. The differing permeability of the proppants enhances the circulation of the oil recovery fluids (steam, solvent and injected/combusted gases) into the formed fracture so that the oil recovery fluids can be extended laterally a greater distance compared to a hydraulic fracture filled with a uniform permeable proppant. That is the proppant materials are selected so that the proppant material 50 has the highest proppant permeability, with proppant material 51 has a lower proppant permeability, and with proppant material 52 having the lowest proppant permeability. Such selection of proppant permeability can optimize the lateral extent of the oil recovery fluids flowing within the hydraulic fractures and controlling the geometry and propagation rate of the combustion front. The permeability of the proppant materials will typically range from 1 to 100 Darcy for material in the fracture zone 50, i.e. generally being at least 10 times greater than the bitumen formation permeability. The proppant material in fracture zone 51 is selected to be lower than the material in fracture zone 50 by at least a factor of 2, and proppant material in fracture zone 52 close to the well bore casing 1 is selected to be in the milli-Darcy range thus limiting fluid flow in the fracture zone 52.

Referring to FIG. 3 for the in situ combustion process of oil sands, the casing 1 is washed clean of fracturing fluids and screens 25 and 26 are present in the casing as a bottom screen 25 and a top screen 26 for hydraulic connection from the casing well bore 1 to the propped fractures 30 and the oil sand formation 8. A downhole electric pump 17 is placed inside the casing, connected to a power and instrumentation cable 18, with downhole packer 19, drop tube 16 for flue gas extraction, drop tube 29 for injection of oxygen enriched gas, and piping 9 for production of the produced hydrocarbons to the surface. The oxygen enriched injection gas is injected into the well bore at the top of the hydraulic fractures, through the drop tube 29, through the screen 26, and into the propped fractures 30 and oil sand formation 8, as shown by flow vectors 12. The injection pressure is very close to reservoir ambient pressure. The in situ hydrocarbons in the formation 8 in the vicinity of the injected gas are ignited by a downhole burner. The resulting combustion front generates significant heat, which softens the bitumen in front of the combustion front 10 and forms a fluid mobile hydrocarbon zone 28 in front of the combustion front 10. The oil in the mobile zone 28 drains by gravity 11 down to the bottom of the hydraulic fracture creating an oil pool 54 and enters as shown by flow vectors 15 into the well bore through the lower screen 25 and accumulates at location 13 adjacent the pump 17. The accumulated oil is pumped by the pump 17 as shown by arrows 14 through the tubing 9 to the surface. The flue gas flows down to the lower screen 25 as shown by flow vectors 27 in the spent combusted zone and is extracted by the drop tube 16. The extraction rate of the flue gas controls the propagation rate and growth of the combustion front, and the resultant oxygen content of the flue gas. The extraction rate of the flue gas is balanced to maintain an approximately horizontal combustion front with good vertical and lateral sweep, and resulting in low oxygen content in the flue gas. The operating pressure of the process is selected to be close to the ambient reservoir pressure to minimize water inflow into the process zone. The highly permeable hydraulic fractures enable close control of flue gas exhaust and thus minimize the pressure difference between the injected and exhausted gases required to operate the process. The contrast in proppant permeability of the propped hydraulic fracture 30, i.e. zones 50, 51 and 52, control the flow of injected and combusted gases and therefore controls the shape of the combusted front moving through the bitumen formation 8. A low permeable proppant 52 placed close to the well bore casing 1 will limit the extent of combustion in this zone and thus reduce the exposure of the well bore casing 1 to combustion temperatures.

The combustion zone 10 initially grows radially from the well bore casing 1, i.e. parallel to the propped fractures 30. The combustion front becomes predominantly horizontal as it reaches the lateral extent 31 of the hydraulic fractures 30 and then propagates vertically downwards eventually reaching the vertical extent 32 of the propped fracture system 30. At that point, the combustion front propagates radially back towards the well bore casing 1. At this time, the bitumen in the lateral 31 and vertical 32 extent of the propped fractures 30 is completely mobilized or spent by the combustion process. It is at this stage that the process may be stopped to limit the impact of the high combustion temperatures impacting the well bore and also the potential for the injected gas to preferentially short circuit to the flue gas extraction location at the bottom of the well bore rather than be consumed in the combustion process. The optimum configuration of the process, i.e. its maximum lateral reach, will depend on the height of the pay zone, the contrast in permeability of the proppant materials, the horizontal and vertical permeabilities of the pay zone, the extent of barren or shale lenses within the pay zone, and the ratio of propped fracture permeability to host oil sand permeability.

Figure 4:
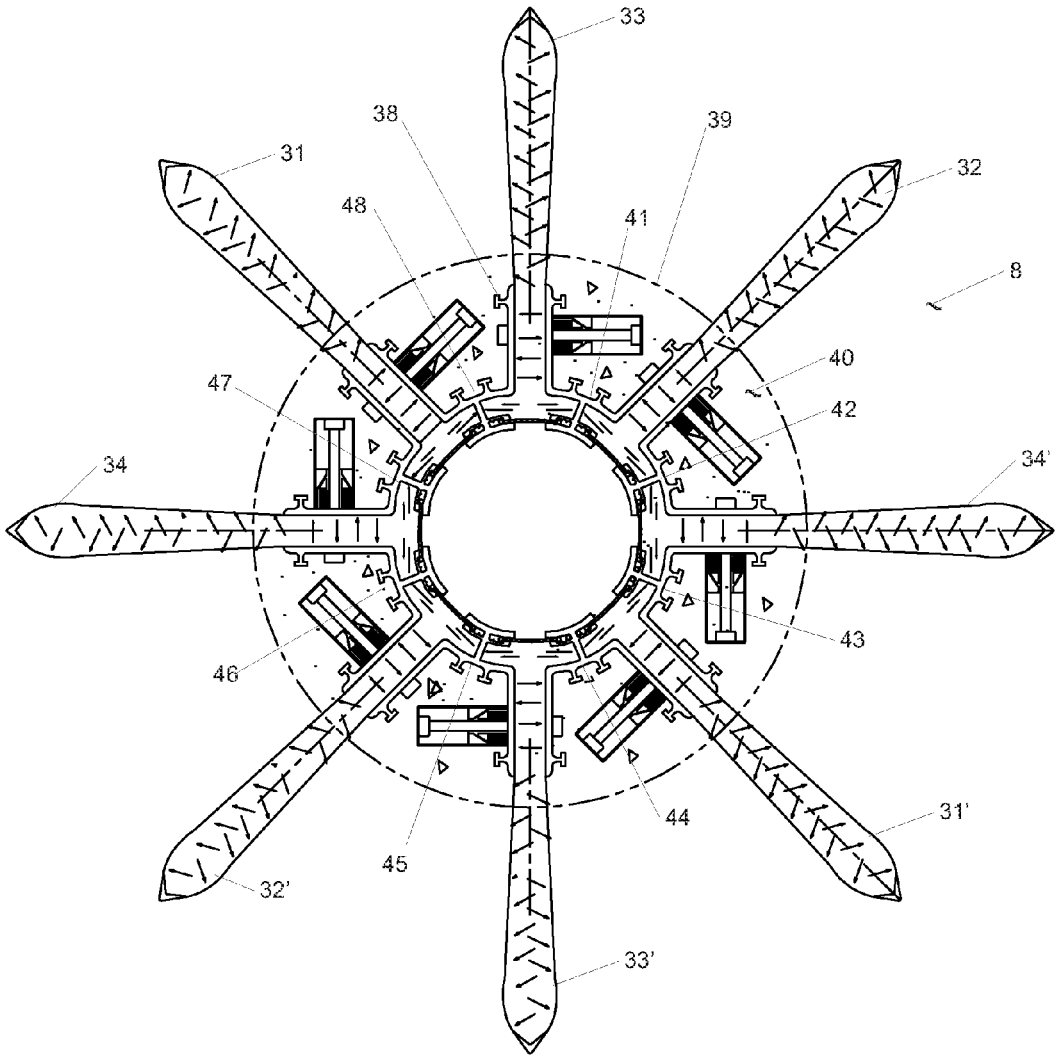
FIG. 4 is a horizontal cross-section view of a well casing having multiple fracture dual winged initiation sections after initiation of all four controlled vertical fractures.
Figure 5:
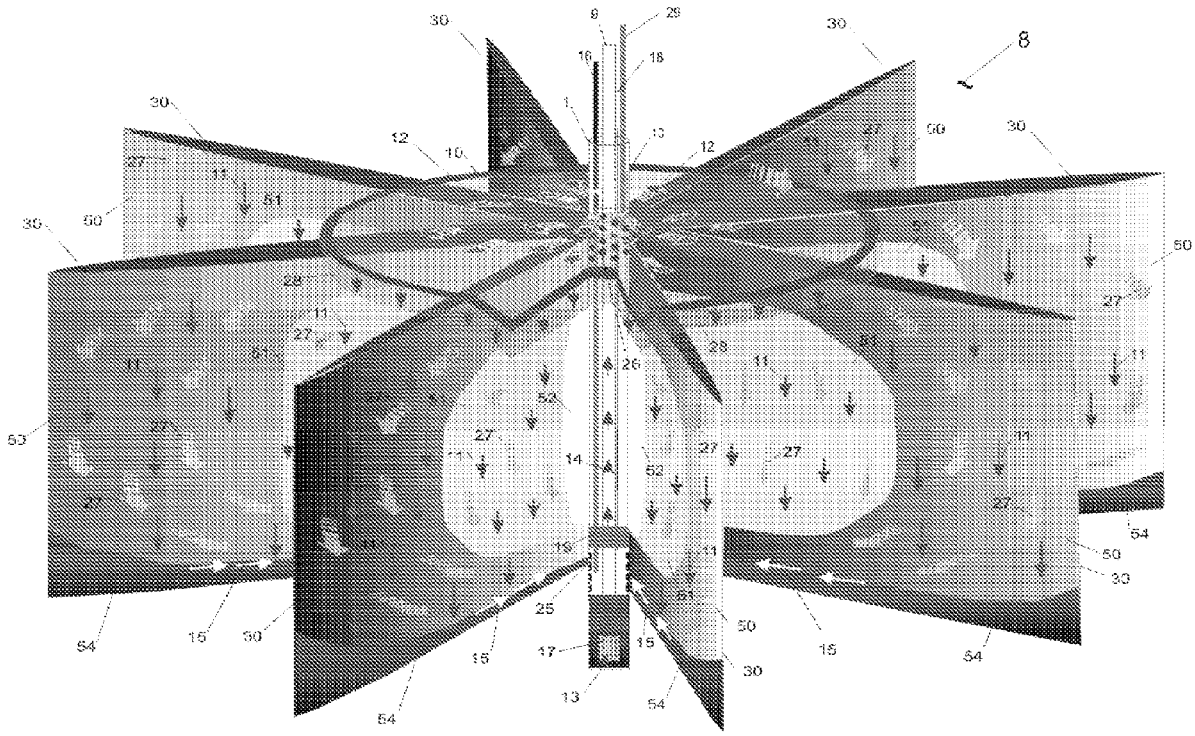
FIG. 5 is an isometric view of a well casing having four propped fractures with downhole injected oxygen enriched gas, combustion front, and gravity flow of produced hydrocarbons.

Another embodiment of the present invention is shown on FIGS. 4 and 5, consisting of an injection casing 38 inserted in a bore hole 39 and grouted in place by a grout 40. The injection casing 38 consists of eight symmetrical fracture initiation sections 41, 42, 43, 44, 45, 46, 47, and 48 to install a total of four hydraulic fractures on the different azimuth planes 31, 31', 32, 32', 33, 33', 34, and 34'. The process results in four hydraulic fractures installed from a single well bore at different azimuths as shown on FIGS. 4 and 5. The casing 1 is washed clean of fracturing fluids and screens 25 and 26 are present in the casing as a bottom screen 25 and top screen 26 for hydraulic connection of the casing well bore 1 to the propped fractures 30 and the oil sand formation 8. A downhole electric pump 17 is placed inside the casing, connected to a power and instrumentation cable 18, with downhole packer 19, drop tube 16 for flue gas extraction, drop tube 29 for injection of oxygen enriched gas, and piping 9 for production of the produced hydrocarbons to the surface. The oxygen enriched injection gas is injected into the well bore at the top of the hydraulic fractures through the drop tube 29, through the screen 26 and into the propped fractures 30 and oil sand formation 8, as shown by flow vectors 12. The injection is at a pressure very close to reservoir ambient pressure. The in situ hydrocarbons in the formation 8 in the vicinity of the injected gas 12 are ignited by a downhole burner. The resulting combustion front generates significant heat, which soften the bitumen in front of the front and forms a fluid mobile hydrocarbon zone 28 in front of the combustion front. The oil in the mobile zone 28 drains by gravity 11 down to the bottom of the hydraulic fracture forming a pool of oil 54 and the oil enters as shown by flow vectors 15 into the well bore through the lower screen 25 and accumulates at location 13 adjacent the pump 17. The accumulated oil is pumped by the pump 17 as shown by arrows 14 through the tubing 9 to the surface. The flue gas is extracted by the drop tube 16 and flows down to the lower screen 25 as shown by flow vectors 27. The extraction rate of the flue gas controls the propagation rate and growth of the combustion front and the oxygen content of the flue gas. The extraction rate of the flue gas is balanced to maintain a predominantly horizontal combustion front with good vertical and lateral sweep of the bitumen formation 8, and to yield low oxygen content in the flue gas. The operating pressure of the process is selected to be close to the ambient reservoir pressure to minimize water inflow into the process zone. The highly permeable hydraulic fractures enable close control of flue gas exhaust and thus minimize the pressure difference between the injected and exhausted gases required to operate the process. The contrast in proppant permeability of the propped hydraulic fracture 30, i.e. zones 50, 51 and 52, control the flow of injected and combusted gases and therefore controls the shape of the combusted front moving through the bitumen formation 8.

Finally, it will be understood that the preferred embodiment has been disclosed by way of example, and that other modifications may occur to those skilled in the art without departing from the scope and spirit of the appended claims.

What is claimed is:

1. A well in a formation of unconsolidated and weakly cemented sediments, comprising:

a. a bore hole in the formation to a predetermined depth;

b. an injection casing grouted in the bore hole at the predetermined depth, the injection casing including multiple initiation sections separated by a weakening line and multiple passages within the initiation sections and communicating across the weakening line for the introduction of a fracture fluid to dilate the casing and separate the initiation sections along the weakening line;

c. a source for delivering the fracture fluid into the injection casing with sufficient fracturing pressure to dilate the injection casing and the formation and initiate a vertical hydraulic fracture, having a fracture tip, at an azimuth orthogonal to the direction of dilation to create a process zone within the formation, for controlling the propagation rate of each individual opposing wing of the hydraulic fracture, and for controlling the flow rate of the fracture fluid and its viscosity so that the Reynolds Number Re is less than 100 at fracture initiation and less than 250 during fracture propagation and the fracture fluid viscosity is greater than 100 centipoise at the fracture tip;

d. a source of oxygen rich gas connected to the casing and the propped hydraulic fractures;

e. an ignition source for igniting the hydrocarbon deposit in the presence of the oxygen rich gas, wherein a resulting combustion gas from the formation is exhausted through the casing and petroleum hydrocarbons from the formation are recovered through the casing.

2. The well of claim 1, wherein the injected gas is air.

3. The well of claim 1, wherein the injected gas is a mixture of oxygen and carbon dioxide.

4. The well of claim 3, wherein the combusted gas is separated into carbon dioxide and a fuel gas.

5. The well of claim 4, wherein the carbon dioxide produced is re-injected into the formation.

6. The well of claim 1, wherein the produced hydrocarbon flows through a hot spent combusted zone.

7. The well of claim 1, wherein the hydraulic fractures are filled with proppants of differing permeability.

8. The well of claim 1, wherein the proppant of the hydraulic fractures contains a catalyst or a mixture of catalysts.

9. The well of claim 8, wherein the catalyst is one of a group of hydrodesulfurization catalysts or thermal cracking catalysts or a mixture thereof.

10. The well of claim 1, wherein a catalyst or mixture of catalysts are placed in a canister in the well bore through which the produced hydrocarbons flow.

11. The well of claim 10, wherein the catalyst is one of a group of hydrodesulfurization catalysts or thermal cracking catalysts or a mixture thereof.

12. The well of claim 1, wherein the pressure in the majority of the part of the process zone is at ambient reservoir pressure.

13. The well of claim 1, wherein at least two vertical fractures are installed from the bore hole at approximately orthogonal directions.

14. The well of claim 1, wherein at least three vertical fractures are installed from the bore hole.

15. The well of claim 1, wherein at least four vertical fractures are installed from the bore hole.

16. A method for the in situ recovery of hydrocarbons from a hydrocarbon containing formation, comprising:

a. drilling a bore hole in the formation to a predetermined depth to define a well bore with a casing;

b. installing one or more vertical proppant and diluent filled hydraulic fractures from the bore hole to create a process zone within the formation by injecting a fracture fluid into the casing;

c. injecting an oxygen rich gas into a section of the bore hole connected to the hydraulic fractures, wherein the injected gas is a mixture of oxygen and carbon dioxide;

d. igniting the hydrocarbon deposit;

e. exhausting a combustion gas from the formation, wherein the combusted gas is separated into carbon dioxide and a fuel gas; and f. recovering a hydrocarbon from the formation.

17. The method of claim 16, wherein the carbon dioxide produced is re-injected into the formation.

18. A method for the in situ recovery of hydrocarbons from a hydrocarbon containing formation, comprising:

a. drilling a bore hole in the formation to a predetermined depth to define a well bore with a casing;

b. installing one or more vertical proppant and diluent filled hydraulic fractures from the bore hole to create a process zone within the formation by injecting a fracture fluid into the casing, wherein the hydraulic fractures are filled with proppants of differing permeability;

c. injecting an oxygen rich gas into a section of the bore hole connected to the hydraulic fractures;
d. igniting the hydrocarbon deposit;
e. exhausting a combustion gas from the formation;
f. recovering a hydrocarbon from the formation.

19. A method for the in situ recovery of hydrocarbons from a hydrocarbon containing formation, comprising:
a. drilling a bore hole in the formation to a predetermined depth to define a well bore with a casing;
b. installing one or more vertical proppant and diluent filled hydraulic fractures from the bore hole to create a process zone within the formation by injecting a fracture fluid into the casing;
c. injecting an oxygen rich gas into a section of the bore hole connected to the hydraulic fractures;
d. igniting the hydrocarbon deposit;
e. exhausting a combustion gas from the formation; and
f. recovering a hydrocarbon from the formation, wherein a catalyst or mixture of catalysts are placed in a canister in the well bore through which the produced hydrocarbons flow.

20. The method of claim 19, wherein the catalyst is one of a group of hydrodesulfurization catalysts or thermal cracking catalysts or a mixture thereof.

21. A method for the in situ recovery of hydrocarbons from a hydrocarbon containing formation, comprising:
a. drilling a bore hole in the formation to a predetermined depth to define a well bore with a casing;
b. installing at least three vertical proppant and diluent filled hydraulic fractures from the bore hole to create a process zone within the formation by injecting a fracture fluid into the casing;
c. injecting an oxygen rich gas into a section of the bore hole connected to the hydraulic fractures;
d. igniting the hydrocarbon deposit;
e. exhausting a combustion gas from the formation; and
f. recovering a hydrocarbon from the formation.

22. A method for the in situ recovery of hydrocarbons from a hydrocarbon containing formation, comprising:
a. drilling a bore hole in the formation to a predetermined depth to define a well bore with a casing;
b. installing at least four vertical proppant and diluent filled hydraulic fractures from the bore hole to create a process zone within the formation by injecting a fracture fluid into the casing;
c. injecting an oxygen rich gas into a section of the bore hole connected to the hydraulic fractures;
d. igniting the hydrocarbon deposit;
e. exhausting a combustion gas from the formation; and
f. recovering a hydrocarbon from the formation.

* * * * *